US006930959B2

(12) United States Patent
Narayanaswami

(10) Patent No.: US 6,930,959 B2
(45) Date of Patent: Aug. 16, 2005

(54) MULTI-AXIS WHEEL SCROLLER AND SELECTOR

(75) Inventor: Chandrasekhar Narayanaswami, Wilton, CT (US)

(73) Assignee: International Business Machines Corporation, Armonk, NY (US)

( * ) Notice: Subject to any disclaimer, the term of this patent is extended or adjusted under 35 U.S.C. 154(b) by 211 days.

(21) Appl. No.: 10/444,231

(22) Filed: May 23, 2003

(65) Prior Publication Data

US 2004/0233790 A1 Nov. 25, 2004

(51) Int. Cl.[7] ..... G04C 17/00

(52) U.S. Cl. ..... 368/69; 200/4; 200/14; 200/5 R; 200/61.54; 341/22; 345/156; 345/157

(58) Field of Search ..... 368/69; 200/4, 200/14, 5 R, 61.24; 341/22; 345/156–184

(56) References Cited

U.S. PATENT DOCUMENTS 5,253,227 A * 10/1993 Wong ..... 368/69
5,377,168 A * 12/1994 Kotanagi ..... 368/69
6,021,336 A * 2/2000 Kunihiro et al. ..... 455/550.1
6,198,057 B1 * 3/2001 Sato et al. ..... 200/19.18
6,246,392 B1 * 6/2001 Wu ..... 345/163
6,291,782 B1 * 9/2001 Isikawa ..... 200/14
6,525,997 B1 2/2003 Narayanaswami et al.

FOREIGN PATENT DOCUMENTS

JP 2002-342013 * 11/2002 ..... G06F/3/023

* cited by examiner

*Primary Examiner*—Andrew H. Hirshfeld
*Assistant Examiner*—Andrea H. Evans
(74) *Attorney, Agent, or Firm*—Michael J. Buchenhorne; Casey P. August

(57) ABSTRACT

An information handling apparatus comprises a scrolling wheel; a platform comprising at least one pivot well; a pivot pin attaching the rolling wheel to the platform and allowing rolling movement of the wheel in clockwise and counter-clockwise directions. The pivot pin is connected to the platform such that the pivot pin is movable along a track in the platform from at least a first position to a second position; a spring connected to the pivot pin for providing a variable length to the pivot pin such that the pivot pin is in a normally extended state and is movable to a depressed state when the wheel is pushed in a radial direction toward the platform; and a control mechanism for sensing the pressing of the wheel, the rolling of the wheel, and the motion of the pivot pin along the track, the control mechanism providing a signal responsive to the rolling of the wheel, and the motion of the pivot pin along the track, the control mechanism further providing a first set of control signals responsive to the roll of the wheel when the pivot pin is in the first position and a second set of control signals when the pivot pin is in the second position.

19 Claims, 13 Drawing Sheets

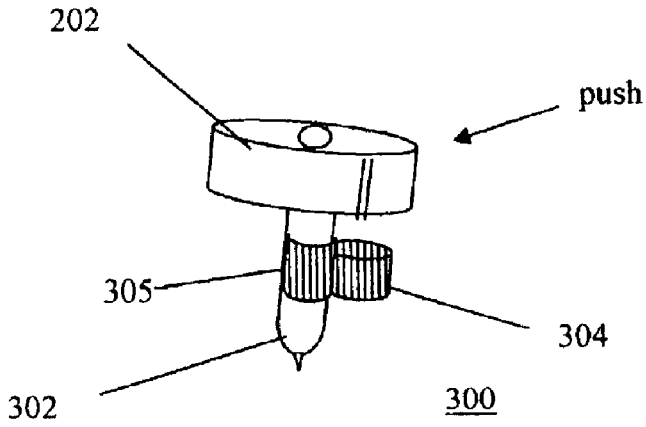
*FIG. 3A: the wheel/pivot assembly*
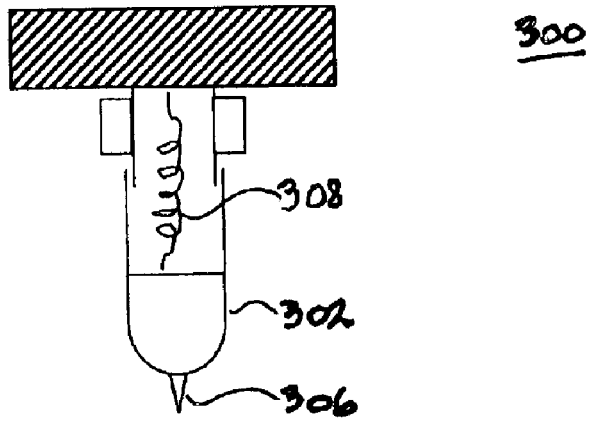
*FIG. 3B*

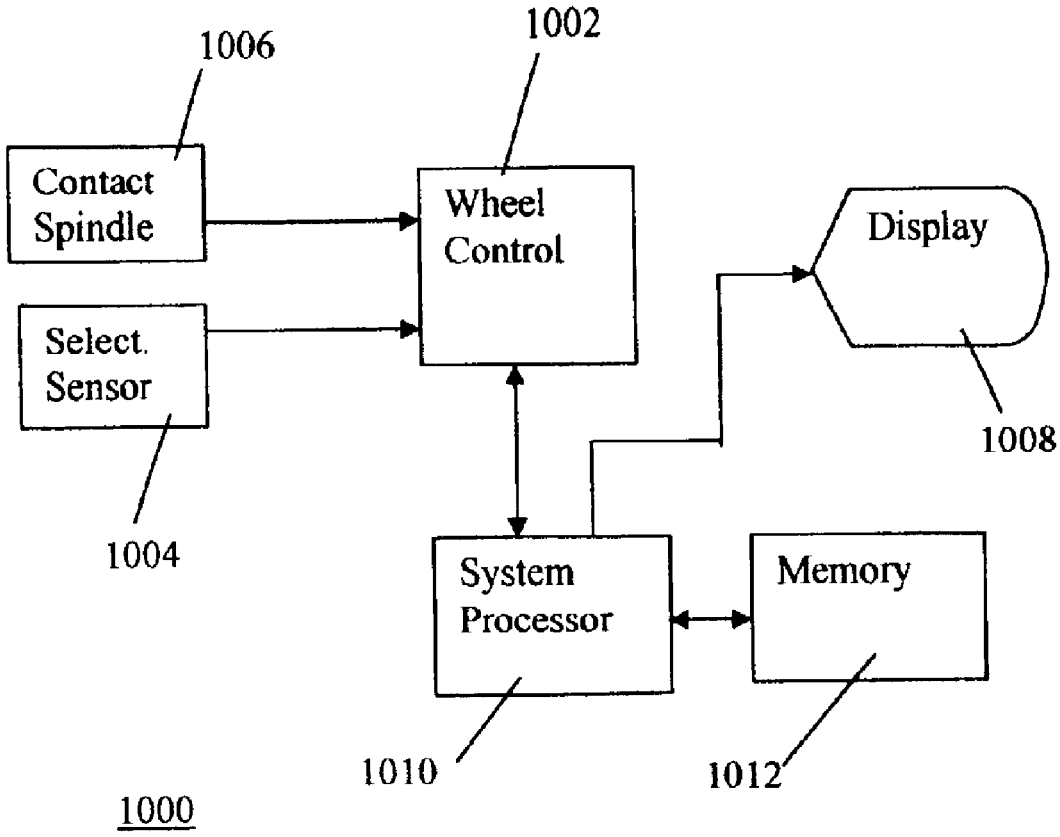
*FIG. 10: the control mechanism*

FIG. 11A
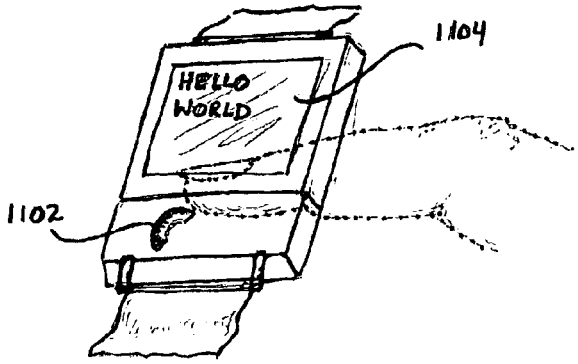
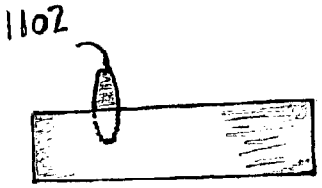
FIG. 11B
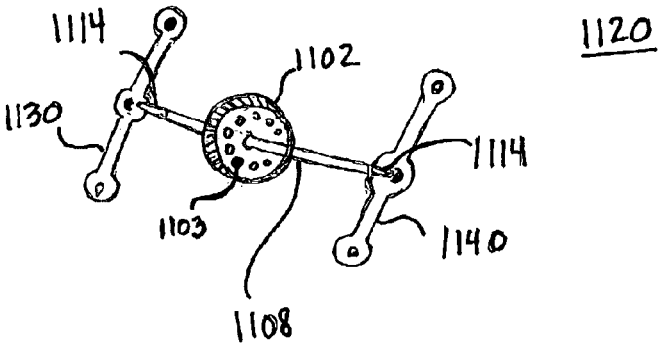
FIG. 11C

MULTI-AXIS WHEEL SCROLLER AND SELECTOR

CROSS-REFERENCE TO RELATED APPLICATIONS

Not Applicable.

FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of control devices, and more particularly relates to the field of control devices using scrolling wheels to control displays on small electronic devices.

BACKGROUND OF THE INVENTION

Roller wheels that roll clockwise and counterclockwise for scroll events and that can be pressed inward radially for generating select events are known. One example of a device that uses such a wheel is the RIM (Research In Motion) 960 Pager. A roller wheel is described in U.S. Pat. No. 6,525,997 B1 "EFFICIENT USE OF DISPLAY REAL ESTATE IN A WRIST WATCH DISPLAY," which is incorporated by reference as if fully set forth herein.

Referring to FIG. 1, there is shown a known wrist-worn electronic device 100 comprising a rolling wheel 104 for controlling a screen 106. The rolling wheel 104 can be rolled up or down (clockwise or counter-clockwise) to simulate a cursor scrolling function. A mouse click event is simulated when the rolling wheel 104 is pushed or depressed. However, such wheels as described in U.S. Pat. No. 6,525,997 have limited degrees of freedom and hence limit the utility of the wheel as a selection device since only vertical scrolling functionality is possible. It would be desirable to have a rolling wheel with horizontal scrolling capabilities and a greater range of movement.

Accordingly there is a need for an input device for information handling systems that overcomes the above shortcoming in the prior art.

SUMMARY OF THE INVENTION

Briefly according to the invention, an input device for an information handling apparatus comprises a rolling wheel device for controlling display functions on a display for an information handling system. The input device comprises a rolling wheel that a user of the system can roll, for example, with a thumb or index finger. The device further comprises a pivot pin attaching the rolling wheel to the platform. The pivot pin allows the rolling movement of the wheel in clockwise and counterclockwise directions so that the user can scroll in either direction. The pivot pin is also connected to the platform such that it is movable along a track in the platform along a plurality of locations along the track. This provides the user with a greater range of movement and functions while using a single wheel and thus increases the user-selectable options on a small electronic device.

The pivot pin is spring loaded for providing a variable length to the pivot pin (or axis) such that the pivot pin is in a normally extended state and is movable to a compressed state as it moves along the track between the operating positions. Once the pin settles in one of the operating positions it resumes its extended state to provide a reliable electrical connection. The device also includes a control mechanism for sensing the pressing of the wheel, the rolling of the wheel, and the motion of the pivot pin along the track. The control mechanism provides a signal to control the information handling system in response to the rolling of the wheel and to the motion of the pivot pin along the track. The control mechanism also provides a first set of control signals responsive to the roll of the wheel when the pivot pin is in the first position and a second set of control signals when the pivot pin is in the second position.

BRIEF DESCRIPTION OF THE DRAWINGS

FIG. 3A shows a wheel/pivot pin assembly according to an embodiment of the invention.

FIG. 3B shows a cross-section of the wheel assembly.

FIG. 10 shows a simplified block diagram of a control mechanism for controlling the display in connection with the movements of the wheel assembly.

FIG. 11A shows an oblique view of a device with a wheel assembly, according to another embodiment of the invention.

FIG. 11B shows a side view of the wheel assembly platform of FIG. 11A illustrating how the scrolling wheel protrudes from the device casing.

FIG. 11C shows an inside view of the wheel assembly of FIG. 11A, according to an embodiment of the invention.

DESCRIPTION OF THE PREFERRED EMBODIMENT

Figure 1:
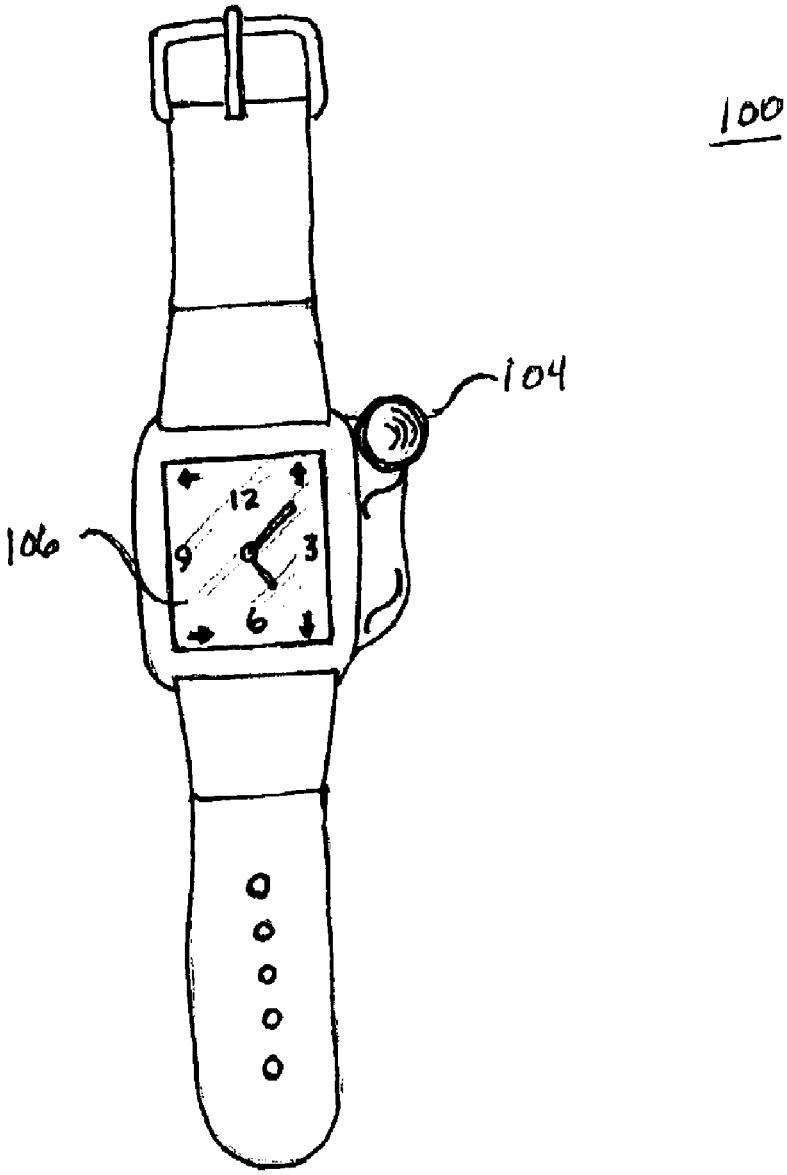
FIG. 1 Prior Art
FIG. 1 is an illustration of a known wrist-worn information processing apparatus.
Figure 2:
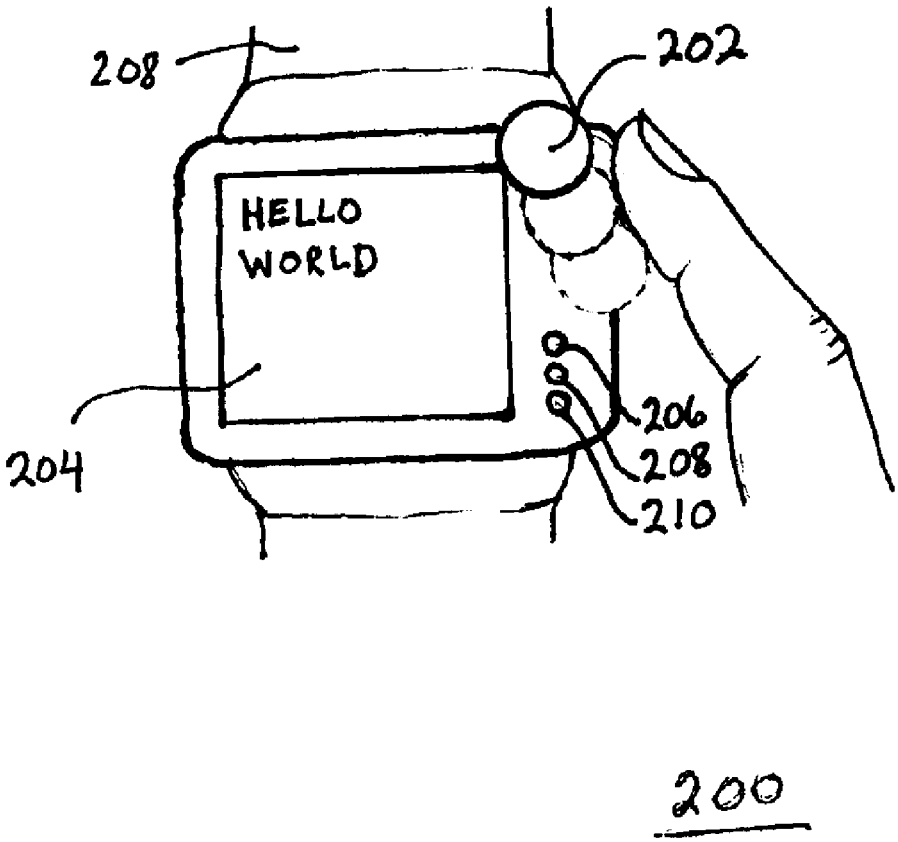
FIG. 2 shows a device comprising a multi-position wheel according to an embodiment of the invention.

Referring to FIG. 2, there is shown a wrist-worn electronic device 200 comprising a rolling wheel 202 for use with a screen 204. The device 200 comprises a wrist-band 208 (partially shown) for attachment to a wrist. According to an embodiment of the invention, the scrolling wheel 202 comprises a pivot pin (shown in FIG. 3A) that is movable along a track in the platform from at least a first position to a second position. A contact spindle tracks the circular position of the wheel 202. In this embodiment three wheel positions can be selected by pushing the wheel 202 along a multi-position track. The wheel 202 can be manipulated into the wheel positions by sliding the wheel 202 into and out of three wheel wells. The pivot pin is spring-loaded to facilitate moving out of one well and into another. The solid wheel 202 shown in FIG. 2 illustrates the first wheel position and the other two wheels shown in broken lines represent the second and third wheel positions. According to another aspect of the invention, the wheel performs different functions at each position. For example, when the wheel 202 is in the first position it controls horizontal scrolling and when it is in the second position it controls vertical scrolling. In the third position a help menu is displayed. The exact function performed in each position can be programmatically set by the application. Using this multi-axis design accomplishes the control functionality of three or more buttons/wheels that would have to be in included in a device. The device 200 cannot accommodate these additional buttons/wheels because of its small size.

The user can be given both visual and haptic feedback as he or she slides the wheel from position to position and is also given an indication as to which well the wheel currently occupies. The visual feedback can be provided by lighting different colored light emitting diodes (LEDs) 206, 208, and 210 corresponding to each position (first, second, and third, respectively) of the wheel 202. The haptic feedback is provided when the user senses that the wheel 202 has landed in a wheel (or pivot) well.

Referring to FIG. 3A, there is shown a wheel/pivot pin assembly 300. The assembly 300 comprises a wheel portion 202 and a pivot pin 302. The wheel 202 rolls as a user turns it in a given direction (clockwise or counter-clockwise). Depending on the position of the wheel 202 along the multi-point track, turning the wheel 202 preferably causes the cursor or pointer on the screen of the device shown in FIG. 2 to move throughout the screen. The rotational movement of the wheel 202 is translated to a position sensor by means of a gear 304 coming in contact with a gear 305 so that gear 304 turns as gear 305 turns. Thus the gear 304 performs as a contact spindle to track the circular position of the wheel 202. Other well-known spindle mechanisms can be used to accomplish this function. Another means to detect the location of the wheel as it is rotated is an optical detector. Element 304 in FIG. 3B represents an optical detector. Thus element 304 can comprise a set of holes like a stroboscope. On one side is a light source and on the other side is a set of optical detectors that count the number of light pulses received.

Referring to FIG. 3B, there is shown a cross-section of the wheel assembly 300 to illustrate one possible spring loading mechanism. There is a spring 308 connected to the pivot pin 302 for providing a variable length to the pivot pin 302 such that the pivot pin 302 is in a normally extended state and is movable to a depressed state when the wheel 202 is pushed in a radial direction toward a platform (see FIG. 4). The spring 308 comprises sufficient strength such that the pivot pin 302 sits firmly in a pivot well (see FIG. 5) and so that the wheel pin 306 makes contact with the bottom of the well.

Figure 4:
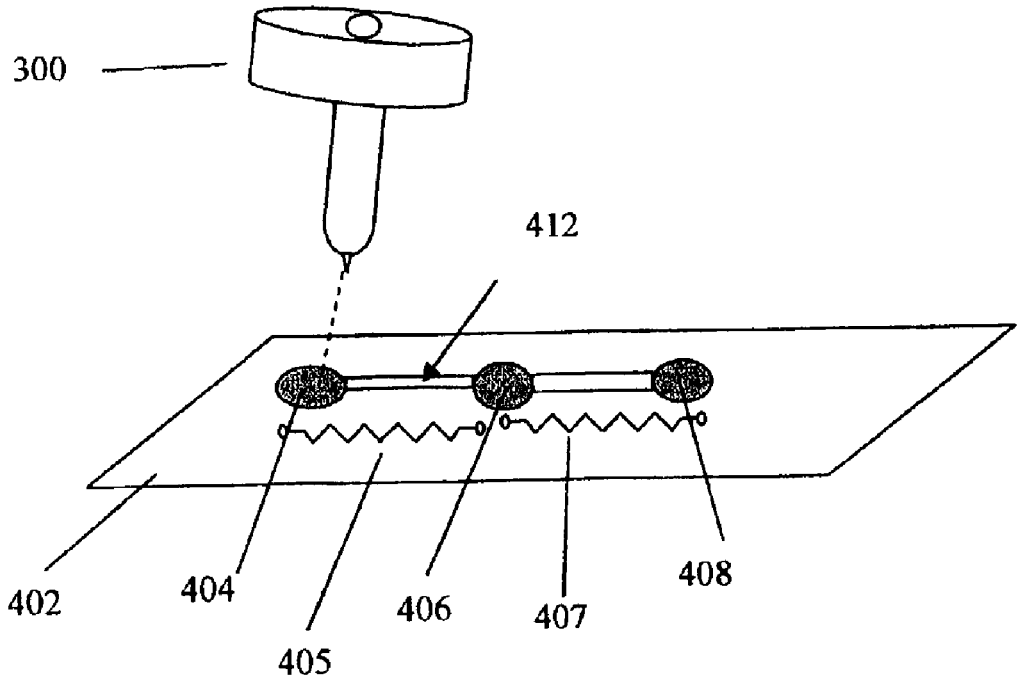
FIG. 4 shows a platform for the wheel assembly.

Referring to FIG. 4, there is shown a platform 402 for the wheel assembly 300. The wheel assembly 300 runs along a track 412 comprising three pivot wells 404, 406, and 408. The position of the wheel 202 is provided to the device 200 by measuring the voltage/current in a resistor network comprising resistors 405 and 407 that connect the multiple wells.

The wheel assembly 300 also comprises a control mechanism for sensing the pressing of the wheel, the rolling of the wheel, and the motion of the pivot pin along the track; the control mechanism provides a signal responsive to the rolling of the wheel, and the motion of the pivot pin along the track. The control mechanism further provides a first set of control signals responsive to the roll of the wheel when the pivot pin is in the first position and a second set of control signals when the pivot pin is in the second position. In the embodiment shown a third set of control signals is provided in a third position.

Figure 5:
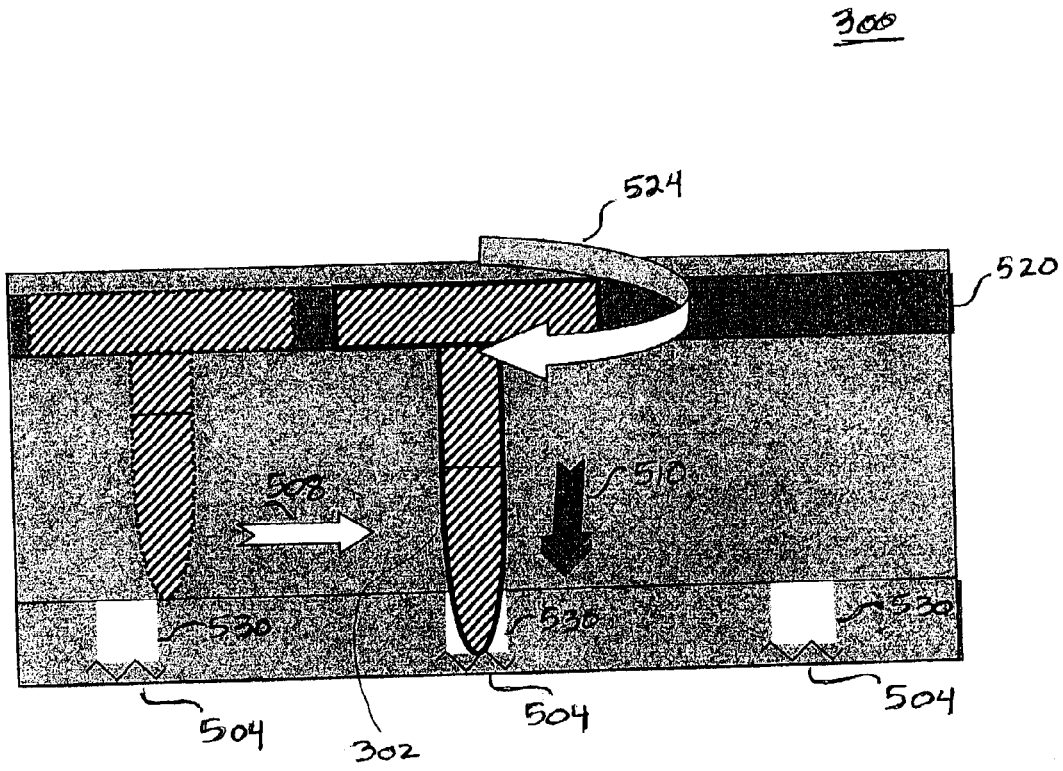
FIG. 5 shows a cross-section of the wheel assembly as it moves from one pivot well to another.

Referring to FIG. 5, there is shown a cross-section of the wrist-worn device 200 and the wheel assembly 300 illustrating the movement of the wheel assembly 300 along a track 506 from one pivot well 530 to another. Each pivot well 530 preferably comprises a beveled shape to prevent unintentional slipping. The pivot pin 302 is spring-loaded so that the spring 308 (shown in FIG. 3B) keeps the pin 302 in a position that provides a sliding contact along the bottom of the well 504, but is retracted when not disposed in the well 504. Haptic feedback is provided to the user when the pivot pin 302 falls into one of the wells 530. The direction in which the slots, or wells 530, are arranged is preferably perpendicular to the direction in which the wheel must be pressed to indicate a selection. This is done to minimize the chance of unintentionally changing slots when the user is pressing the wheel radially to indicate a selection.

The pivot pin 302 is maintained in one of two positions, as shown in FIG. 5. First, when the pivot pin 302 is either situated on or in motion along the track 506, the spring mechanism 308 in the pin 302 maintains the pin 302 in a compressed state. This is reflected by the wheel mechanism on the left-hand side of FIG. 5. The pivot pin 302 is extended just enough to maintain contact with the track 506. This contact exerts pressure to keep the spring 308 coiled (i.e., out of its normal extended state). Movement of the pivot pin 302 along the track 506 is represented by the arrow 508. It should be understood that the arrow 508 is only a simplified representation of movement and that the pin 302 can move backwards and forwards along the track.

Second, when the pivot pin 302 moves over a well 530 it drops down into the well 530, losing its contact with the track 506. This causes the spring to release its tension and the pin 302 slides out as far as it can go until it makes contact with the bottom of the well 530. This contact also completes an electrical contact along the bottom of the wells, represented by the jagged lines 504. Movement of the pin 302 into a well 530 is represented by the two-dimensional forward-facing arrow 510.

To provide stability for the mechanism 300 a second track 520 runs along the top of the wheel platform. The rotating wheel 202 fits tightly enough within this track 520 so that the wheel 202 does not wobble around, but not too tightly that the wheel 202 cannot be rotated in the track by means of applying lateral pressure along the part of the wheel 202 which juts out from the platform. The circular arrow 524 represents the rotating motion of the wheel 202. Although the arrow 524 shows a clockwise motion, it should be understood that the wheel 202 can be rotated in a clockwise or counter-clockwise manner.

Figure 6:
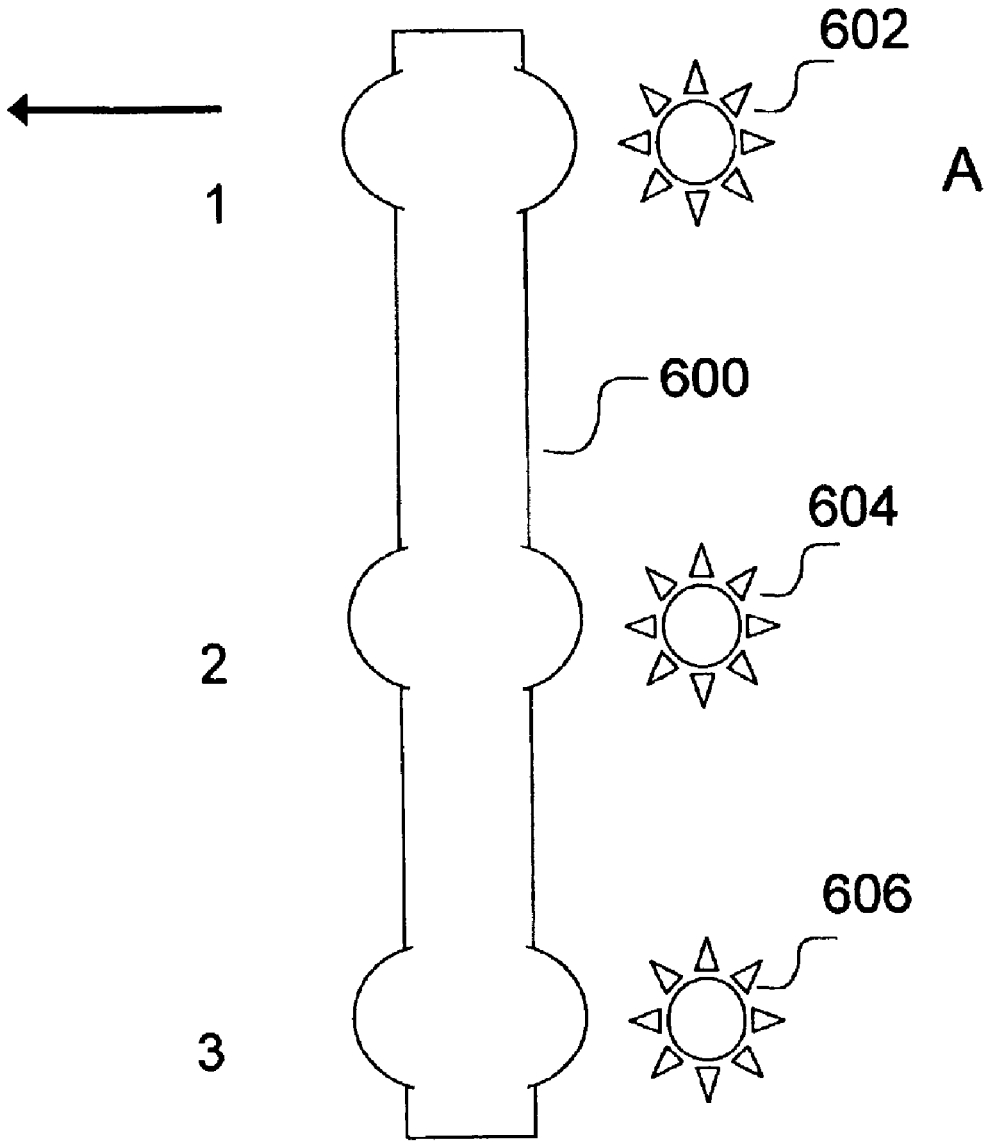
FIG. 6 shows a top view of the track and gears for engaging the pivot pin gears.

Referring to FIG. 6, there is shown a top view of the track 412 and gears 602, 604, and 606, each respectively corresponding to positions 1, 2, and 3 for the wheel assembly 300. When the wheel assembly 300 is in position 1 it engages with gear 602 such that rotating the wheel 202 produces a rotation of gear 602. When the wheel 202 is moved from position 1 to position 2 gear 602 moves toward position A to disengage with the wheel 202. Once the wheel 202 has left the well corresponding to position 1, the gear 602 pops back into place. A spring force is applied to each of the gears 602 to 606 to accomplish this effect as the wheel assembly 300 moves from well to well.

Figure 7:
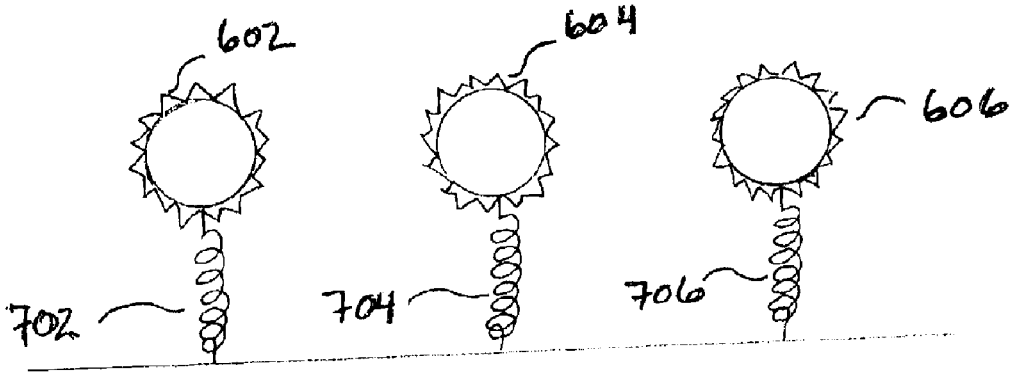
FIG. 7 shows an embodiment where discrete springs are used to provide the spring force.
Figure 8:
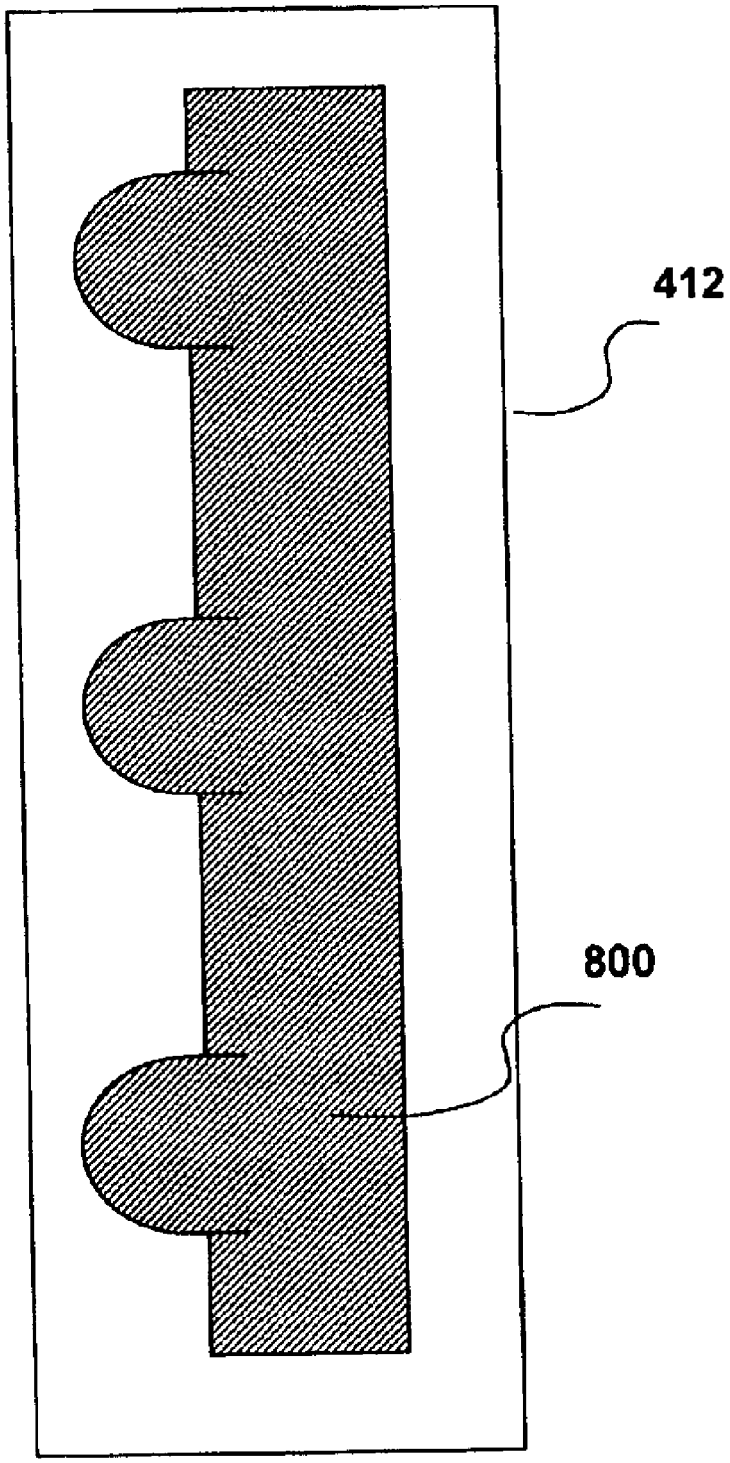
FIG. 8 shows a grooved path along which the wheel tip can slide.

FIG. 7 shows an embodiment where discrete springs 702, 704, and 706 are used to provide the spring force discussed above. FIG. 8 shows a grooved path 800 in track 412 along which the wheel tip 306 can slide.

Figure 9A:
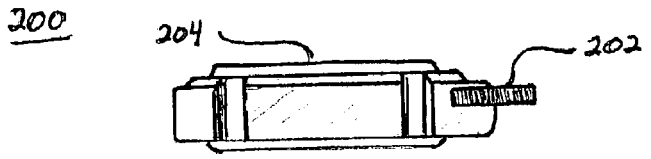
FIG. 9A is a side cross-sectional view of a wristwatch with the rotating wheel, according to an embodiment of the invention.

Referring to FIG. 9A, there is shown a side view of the watch casing of the device 200 with the rotating wheel 202 illustrating where the scroll wheel assembly 300 is located on the watch. The face, or display of the watch 204 is shown on the top.

Figure 9B:
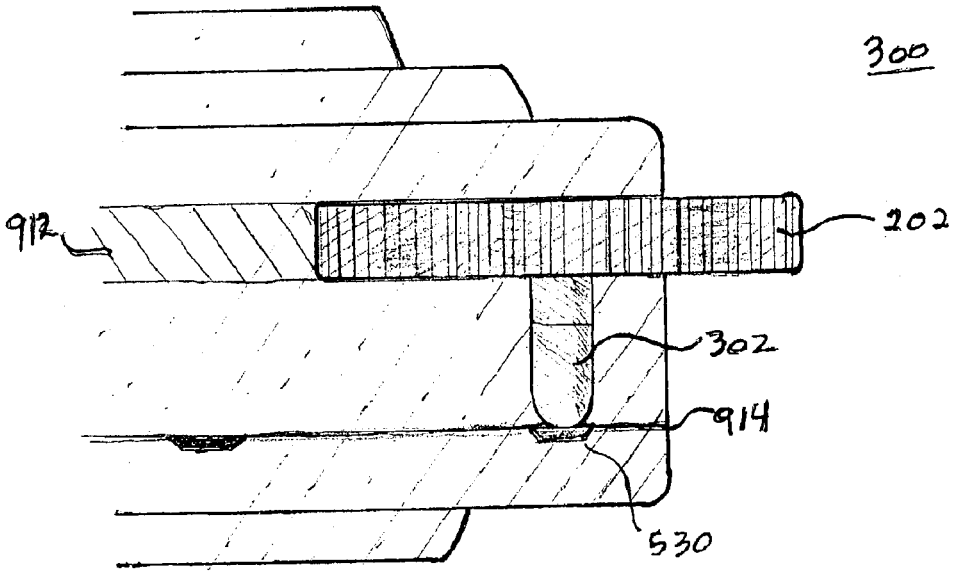
FIG. 9B is a close-up cross-sectional side view of the rotating wheel.

FIG. 9B shows a close-up, cross-section view of the scroll wheel assembly 300 of FIG. 9A. The pivot pin 302 runs along track 914. The wheel 202 runs along track 912. The wheel assembly 300 is held in place by the upper and lower portions of the device 200. As discussed above, the pin 302 comprises a spring mechanism that urges the pin 302 toward the bottom of the well 530. The two tracks 912 and 914 are used to provide stability in the movement of the pin 302 and the wheel 202.

Referring to FIG. 10, there is shown a control mechanism 1000 for controlling the display in connection with the movements of the wheel assembly 300. The system 1000 comprises a wheel control circuit 1002 that receives input signals from a contact spindle motion detector 1006 and a selection sensor 1004 that senses when a user has made a selection by pressing wheel 202. A system processor 1010 controls the operation of the device 200 including the display 1008. The system processor 1010 receives signals representing the position of the wheel assembly 300 and processes them to generate control signals for the display 1008. Memory 1012 stores instructions for carrying out the steps according to a method of the invention.

Referring to FIG. 11A there is shown an alternative embodiment wherein the wheel 1102 is disposed perpendicular to the display 1104. In this embodiment, the wheel 1102 is partly exposed. FIG. 11B shows a side view of the wheel 1102.

FIG. 11C shows a view of the inside of the wheel mechanism 1120. The wheel 1102 has one axle 1108 running through it. The axle 1108 has pivot pins 1114 on both sides. Each pivot pin 1114 is spring-loaded similar to the pivot pin 202 from FIG. 2. Two tracks 1130 and 1140 are shown, with three wells in each track. Just as in the previous embodiments the wheel 1102 can be rotated clockwise and counterclockwise and the wheel can be moved up and down along the tracks 1130 and 1140.

The wheel 1102 comprises a plurality of holes 1103 for optical detection of the position of the wheel 1102 along the tracks 1130 and 1140. This can be accomplished by providing a light source on one side of the wheel 1102 and a light receptor on the other side. The light source can be a small light-emitting diode (LED) and the light receptor can be a grid of photo-electric cells on the opposing side. The amount of light that passes to the receptor varies according to the position of the wheel. The holes can also supply optical information of the transverse position of the wheel 1102 as it is rotated. The holes can vary in size and pattern along the wheel so that the amount and pattern of light transmitted to the receptor indicates the exact rotational position of the wheel 1102.

Figure 12:
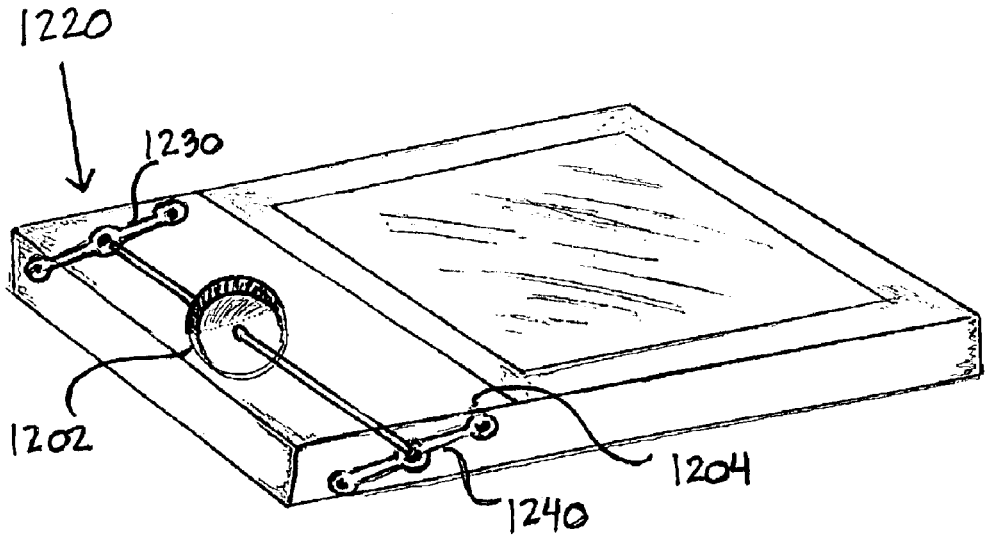
FIG. 12 shows an oblique cut-away view of the device of FIG. 11A, with the wheel assembly employing inclined tracks.

FIG. 12 shows an oblique view of the wheel mechanism 1220. In this embodiment the wheel 1202 runs along inclined tracks 1230 and 1240. Inclining the tracks in this manner makes the wheel 1202 easier to push downward. Also, by inclining the tracks 1230 and 1240 while maintaining the platform 1204 level, differing degrees of the wheel 1202 are exposed, depending on its position along the tracks. This provides visual feedback to the user. FIG. 12 shows the wheel 1202 in position 2 (the middle position) along the tracks 1230 and 1240. In this position, approximately thirty percent of the wheel is exposed. A user would be able to tell at a glance, by seeing that one-third of the wheel is exposed, that the wheel is engaged in position 2. In position 1 forty percent of the wheel is exposed and in position 3 only ten to twenty percent of the wheel is exposed.

Figure 13:
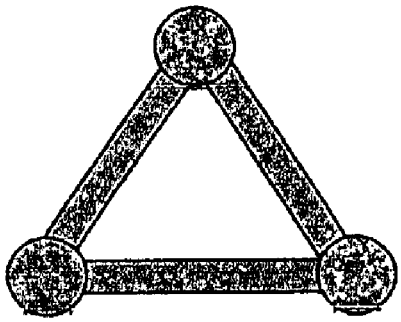
FIG. 13 shows a set of tracks and pivot wells in a triangular pattern, according to an embodiment of the invention.
Figure 14:
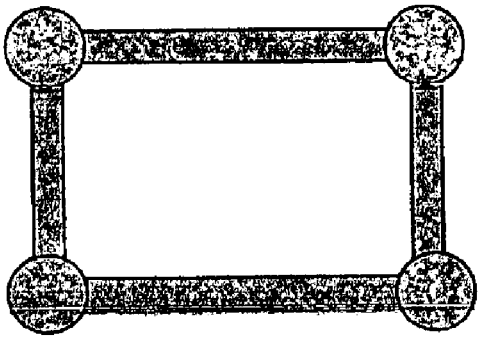
FIG. 14 shows a set of tracks and pivot wells in a rectangular pattern, according to an embodiment of the invention.

Other embodiments are contemplated wherein the pivot wells are not positioned in a collinear fashion along a track. FIG. 13 shows a track with three pivot wells arranged in a triangular grid formation. FIG. 14 shows a track with four pivot wells arranged in a rectangular grid formation. It should be understood that these examples are meant to represent a sampling of possible formations. Other patterns can and should be contemplated within the spirit and scope of the invention.

Therefore, while there has been described what is presently considered to be the preferred embodiments, it will be understood by those skilled in the art that other modifications can be made within the spirit of the invention.

I claim:

1. An input device for an information handling apparatus, comprising:

a rolling wheel;

a pivot pin attached to the rolling wheel allowing rolling movement of the wheel in clockwise and counterclockwise directions;

a platform comprising a wheel track for supporting the wheel as it moves in a lateral direction and at least one pivot pin track comprising a plurality of pivot wells;

the pivot pin having a tip providing a sliding contact for sliding in the platform such that the pivot pin is movable along the pivot pin track in the platform from at least a first operating position to a second operating position;

wherein the pivot pin comprises a spring for providing a variable length to the pivot pin such that the pivot pin is in a normally extended state and is movable to a depressed state such that the pin maintains contact with the bottom of the track at least when it is in one of the operating positions; and a sensor for detecting the pressing of the rolling wheel when the wheel is in one of the operating positions, a sensor for detecting the rotation of the rolling wheel; and a control mechanism for providing a first set of control signals responsive to the sensed rotation and for providing a second set of signals responsive to the sensed pressing of the rolling wheel when the pivot pin is in the first operating position and a third set of control signals when the pivot pin is in the second operating position.

2. The input device of claim 1, further comprising at least a first well along the track for establishing the first operating position and a second well along the track for establishing the second operating position.

3. The input device of claim 1, further comprising a third well along the track for establishing a third operating position and wherein the control mechanism provides a third set of control signals when the pivot pin is in a third operating position.

4. The input device of claim 1 further comprising a spring so that when the rolling wheel is pressed in a direction substantially perpendicular to the track connecting the wells the spring is moved out of its normal state for providing a signal responsive to the pressing.

5. The input device of claim 1 wherein when the pivot pin is in the first operating position, rotating the rolling wheel controls horizontal scrolling on a screen.

6. The input device of claim 1 wherein when the pivot pin is in the second operating position, rotating the rolling wheel controls vertical scrolling on a screen.

7. The input device of claim 1 wherein when the pivot pin is in a third operating position rotating the rolling wheel controls a help menu on a screen.

8. The input device of claim 1 further comprising a haptic feedback mechanism for a user as the user slides the pivot pin along the track to alert the user when the pin is in one of the operating positions.

9. The input device of claim 1 further comprising a visual feedback mechanism for a user as the user slides the pivot pin along the track to alert the user when the pin is in one of the operating positions.

10. The input device of claim 1 wherein the visual feedback mechanism comprises a plurality of different colored light emitting diodes, each for indicating a different operating position of the rolling wheel.

11. The input device of claim 1 wherein the control mechanism is responsive to pressing the rolling wheel to provide a selection signal.

12. The input device of claim 1 wherein the wells are arranged in a direction perpendicular to the direction in which the rolling wheel is pressed to make a selection.

13. The input device of claim 1 wherein the control mechanism comprises a resistor network connected to the wells so that the control mechanism determines the location of the pivot pin by voltage or current in the resistor network.

14. The input device of claim 1 further comprising a second track for the wheel to slide along.

15. The input device of claim 1 further comprising an axle running through the rolling wheel with pivot pins on either side of the axle.

16. The input device of claim 15 wherein the device comprises two parallel tracks such that the pivot pins run along the parallel tracks.

17. The input device of claim 16 wherein the tracks are inclined.

18. The input device of claim 1 further comprising a light source on one side of the rolling wheel; and a light receptor on another side of the rolling wheel for determining a position of the wheel.

19. The input device of claim 18 wherein the rolling wheel comprises a plurality of holes in various positions throughout the wheel such that light emitted from the light source on one side of the rolling wheel can be detected by the light receptor on the other side of the rolling wheel.

* * * * *